US010558157B2

(12) United States Patent
Nishimura

(10) Patent No.: US 10,558,157 B2
(45) Date of Patent: Feb. 11, 2020

(54) POSTPROCESSING DEVICE AND IMAGE FORMING APPARATUS

(71) Applicant: KYOCERA Document Solutions Inc., Osaka (JP)

(72) Inventor: Jun Nishimura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/135,530

(22) Filed: Sep. 19, 2018

(65) Prior Publication Data

US 2019/0086856 A1 Mar. 21, 2019

(30) Foreign Application Priority Data

Sep. 20, 2017 (JP) ..... 2017-179973

(51) Int. Cl.
*B65H 31/38* (2006.01)
*G03G 15/00* (2006.01)

(52) U.S. Cl.
CPC ..... *G03G 15/6573* (2013.01); *B65H 31/38* (2013.01); *G03G 15/6541* (2013.01); *B65H 2301/4213* (2013.01); *B65H 2301/4222* (2013.01); *B65H 2301/4223* (2013.01); *B65H 2405/11151* (2013.01); *B65H 2701/1315* (2013.01); *G03G 2215/00827* (2013.01)

(58) Field of Classification Search
CPC ..... G03G 15/6541; G03G 15/6573; G03G 2215/00827; B65H 31/38; B65H 2301/4213; B65H 2301/4222; B65H 2301/4223; B65H 2405/11151; B65H 2701/1315
USPC ..... 270/58.12
See application file for complete search history.

(56) References Cited

U.S. PATENT DOCUMENTS 5,419,545 A * 5/1995 Hutson ..... B65H 29/14 271/220
6,142,469 A * 11/2000 Nanba ..... B65H 31/10 270/52.03
6,412,774 B1 * 7/2002 Saito ..... B42C 1/12 271/220
6,601,846 B2 * 8/2003 Saito ..... B65H 31/34 270/58.12
7,172,186 B2 * 2/2007 Saito ..... B65H 29/34 270/58.08
7,318,584 B2 * 1/2008 Kato ..... B42C 1/125 270/58.08
7,549,621 B2 * 6/2009 Kotani ..... B65H 29/36 270/58.02

(Continued)

FOREIGN PATENT DOCUMENTS

JP 2009-166971 A 7/2009

*Primary Examiner* — Leslie A Nicholson, III
(74) *Attorney, Agent, or Firm* — Stein IP, LLC

(57) ABSTRACT

The postprocessing device includes: a stapling unit for stapling a sheet bundle with a staple; a discharge tray to which a bound sheet bundle bound with the staple is to be discharged; a moving member movable in both a direction of approaching the discharge tray and a direction of going away from the discharge tray; and a control section for, when the bound sheet bundle has been discharged, driving the moving member to execute a process of making the moving member hit against the bound sheet bundle or against the discharge tray.

11 Claims, 8 Drawing Sheets

(56) References Cited

U.S. PATENT DOCUMENTS

| | | | | |
|---|---|---|---|---|
| 7,566,051 | B2 * | 7/2009 | Kodama | B65H 31/26 270/58.01 |
| 7,624,976 | B2 * | 12/2009 | Koie | B42C 1/12 270/58.02 |
| 8,070,150 | B2 * | 12/2011 | Tanaka | B65H 31/10 270/58.11 |
| 8,408,540 | B2 * | 4/2013 | Uchiyama | B65H 31/26 271/207 |
| 2009/0184459 | A1 | 7/2009 | Yamaguchi | 271/210 |

* cited by examiner

POSTPROCESSING DEVICE AND IMAGE FORMING APPARATUS

INCORPORATION BY REFERENCE

This application is based upon and claims the benefit of priority from the corresponding Japanese Patent Application No. 2017-179973 filed on Sep. 20, 2017, the entire contents of which are incorporated herein by reference.

BACKGROUND

The present disclosure relates to a postprocessing device, as well as an image forming apparatus, for performing postprocessing such as stapling process for sheet bundles.

Conventionally, there is known a postprocessing device for performing stapling process on sheet bundles. A postprocessing device is installed, for example, on an image forming apparatus that prints out images on paper sheets. The postprocessing device performs a process of binding together sheet bundles each containing plural printed sheets by means of staples of a stapler.

A discharge tray is provided in the postprocessing device. The postprocessing device, after performing the stapling process on a sheet bundle, discharges the stapling-processed sheet bundle (bound sheet bundle) onto the discharge tray. Such bound sheet bundles, when discharged in succession, are stacked one after another on the discharge tray.

SUMMARY

A postprocessing device according to a first aspect of this disclosure includes: a stapling unit, a discharge tray, a moving member, and a control section. The stapling unit performs a stapling process of stapling a sheet bundle with a staple. To the discharge tray, a bound sheet bundle bound with the staple is to be discharged. The moving member is movable in both a direction of approaching the discharge tray and a direction of going away from the discharge tray. When the bound sheet bundle has been discharged to the discharge tray, the control section drives the moving member to execute a process of making the moving member hit against the bound sheet bundle discharged to the discharge tray or against the discharge tray.

An image forming apparatus according to a second aspect of the disclosure includes the postprocessing device.

DETAILED DESCRIPTION

<General Configuration of Multifunction Peripheral>

Figure 1:
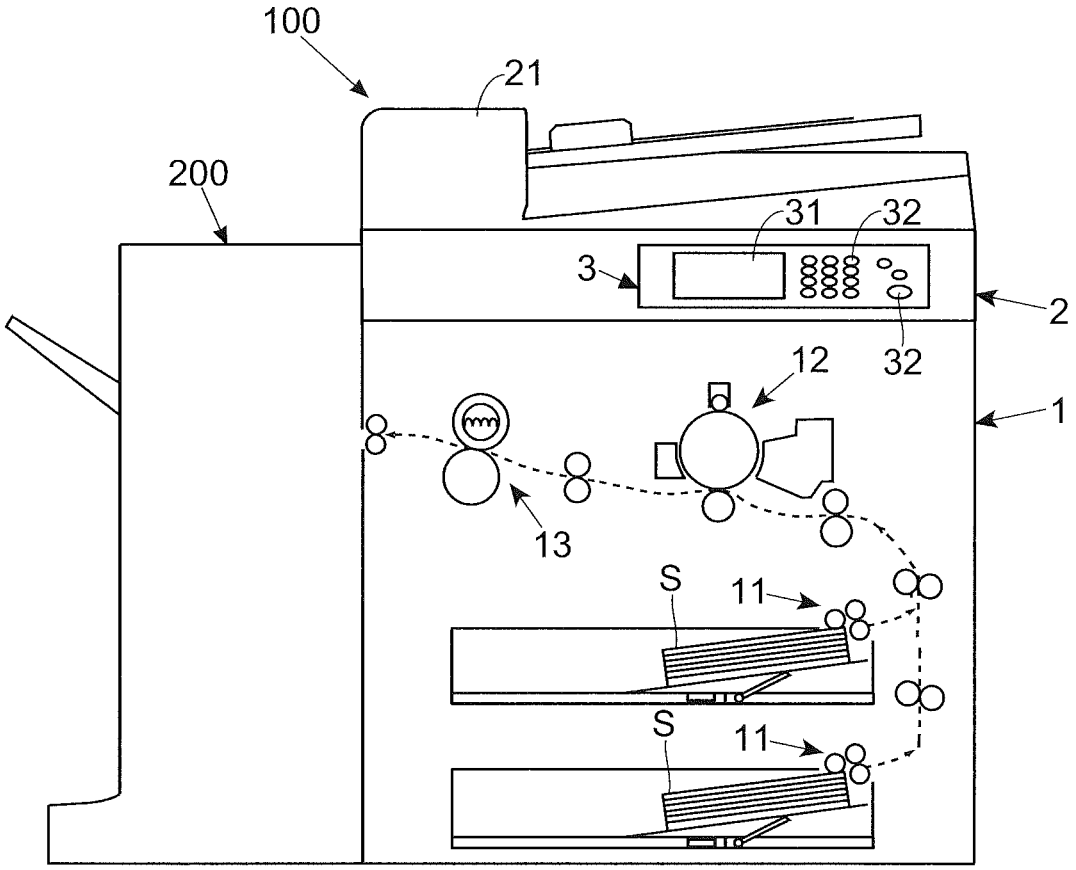
FIG. 1 is a view showing a configuration of a multifunction peripheral including a postprocessing device according to one embodiment of the disclosure.

As shown in FIG. 1, a multifunction peripheral 100 (corresponding to 'image forming apparatus') of this embodiment includes a printing section 1 and an image reading section 2.

The printing section 1 conveys a sheet S of plain paper or the like along a sheet conveyance path (shown by broken line in FIG. 1). Also, the printing section 1 forms a toner image based on image data of an image to be printed (e.g., image data of an original document read by the image reading section 2). Then, the printing section 1 transfers the toner image onto the sheet S that is under conveyance. In addition, the printing section 1 includes: a sheet feed part 11 for feeding a sheet S contained in a sheet cassette onto the sheet conveyance path; an image forming part 12 for forming and transferring a toner image onto the sheet S; a fixing part 13 for fixing, on the sheet S, the toner image that has been transferred onto the sheet S; and the like.

The image reading section 2 includes a reading unit (not shown) including a light source, an image sensor, and the like. The reading unit reads a document placed on an unshown placement-and-reading contact glass. The image reading section 2 also includes a document conveyance unit 21 that conveys a document onto an unshown conveyance-and-reading contact glass. In document reading with use of the document conveyance unit 21, while a document conveyed by the document conveyance unit 21 is passing through on the conveyance-and-reading contact glass, the document is read by the reading unit.

The multifunction peripheral 100 further includes an operation panel 3. The operation panel 3 includes a touch panel display 31, hardware keys 32, and the like. The touch panel display 31 displays software keys and messages, and accepts various types of settings from a user. The hardware keys 32 are provided in plurality on the operation panel 3. As an example, a start key for accepting an execution instruction for a print job from the user is provided as a hardware key 32 on the operation panel 3.

In this case, the multifunction peripheral 100 includes a postprocessing device 200. In execution of a print Job, the multifunction peripheral 100 including the postprocessing device 200 carries a printed sheet S into the postprocessing device 200, and discharges the printed sheet S from the postprocessing device 200. For example, the postprocessing device 200 performs postprocesses such as punching process and stapling process on the printed sheet S. In some cases, the printed sheet S may be discharged without being postprocessed.

<Configuration of Postprocessing Device>

Figure 2:
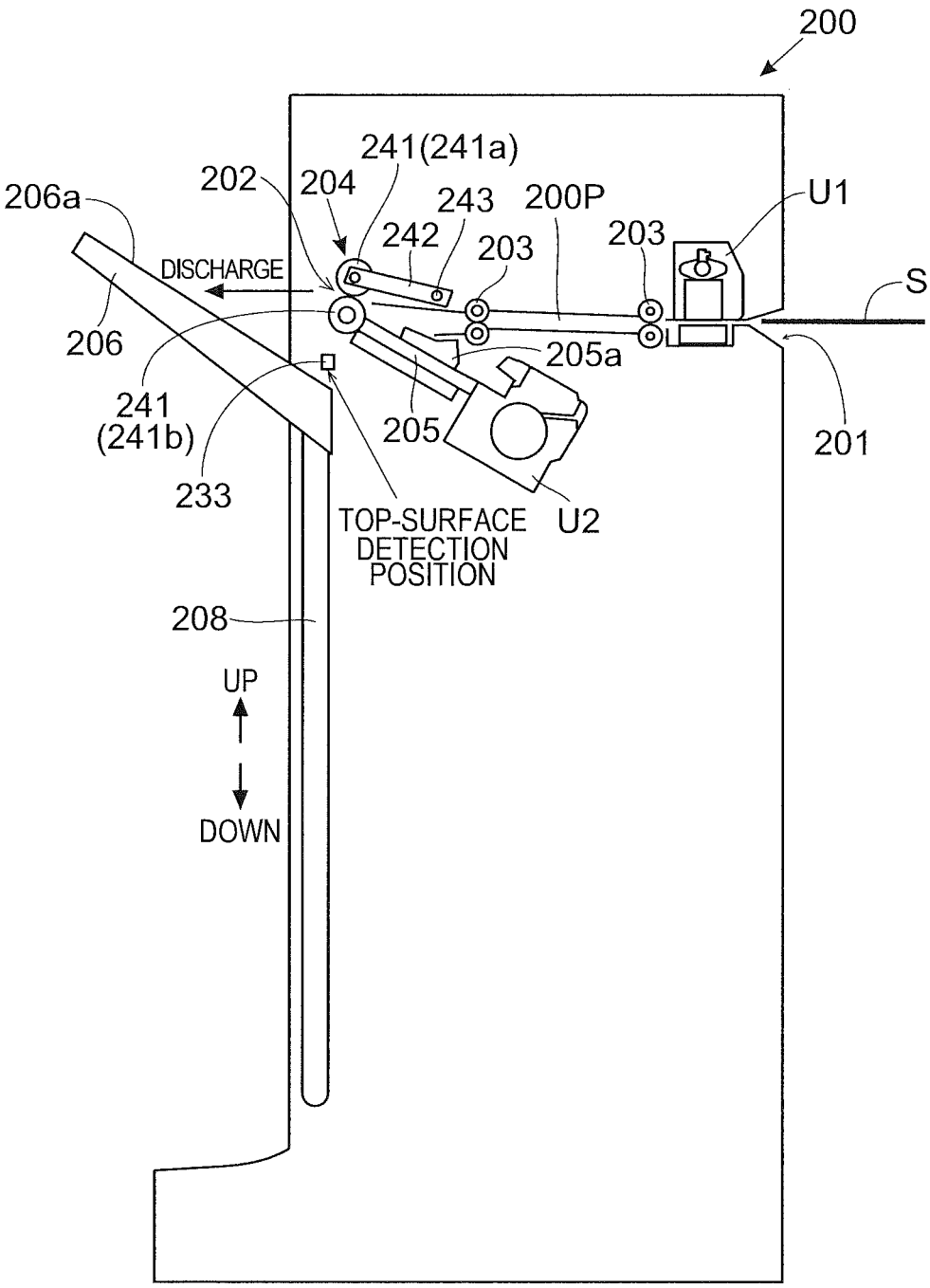
FIG. 2 is a view showing a configuration of the postprocessing device according to one embodiment of the disclosure.

As shown in FIG. 2, the postprocessing device 200 has a carry-in opening 201 for carrying in the sheet S and a discharge opening 202 for discharging out the sheet S. Then, the postprocessing device 200 conveys the sheet S, which has been carried in through the carry-in opening 201, along the sheet conveyance path 200P and subjects the sheet S to postprocessing, thereafter discharging out the sheet S through the discharge opening 202. In addition, the postprocessing device 200 is provided with a plurality of conveyance roller pairs 203 for conveying the sheet S along the sheet conveyance path 200P. The conveyance roller pairs 203 rotate on motive power received from a conveyance motor M1 (see FIG. 5). Further, a discharge part 204 for discharging out the sheet S through the discharge opening 202 is provided in the postprocessing device 200.

A punching unit U1 and a stapling unit U2 are provided in the postprocessing device 200. The punching unit U1 performs a punching process on a sheet S. The stapling unit U2 performs a stapling process on a sheet bundle (stacked plural sheets S) placed on a processing tray 205. The stapling unit U2 performs, as the stapling process, a process of binding an end portion of the sheet bundle by means of a staple.

The processing tray 205 is inclined diagonally downward from its one end side (discharge opening 202 side) toward the other end side. Also, the processing tray 205 has a guide 205*a* movable in a widthwise direction of the sheet S. With such a guide 205*a* provided on the processing tray 205, the sheet S placed on the processing tray 205 can be shifted widthwise before being discharged. That is, a classifying process is enabled. In addition, in some cases, sheet bundles subjected to no stapling process may be processed as an object of the classifying process, and in other cases, sheet bundles subjected to the stapling process may be processed as an object of the classifying process.

On the discharge opening 202 side of the processing tray 205, a discharge roller pair 241 (upper roller 241*a* and lower roller 241*b*) for discharging the sheet S through the discharge opening 202 is provided. One end of an arm 242 is connected to the upper roller 241*a*, and a pivotal shaft 243 is connected to the other end of the arm 242. When one end of the arm 242 is pivoted upward with the pivotal shaft 243 serving as a fulcrum, the upper roller 241*a* is moved upward, causing the upper roller 241*a* to go away from the lower roller 241*b*. When one end of the arm 242 is pivoted downward with the pivotal shaft 243 serving as a fulcrum, the upper roller 241*a* is moved downward, causing the upper roller 241*a* to approach the lower roller 241*b*.

The discharge roller pair 241, the arm 242, and the pivotal shaft 243 are component members of the discharge part 204. The discharge part 204 includes a discharge motor M2 (see FIG. 5) for rotating the discharge roller pair 241.

For placement of the sheet S onto the processing tray 205, the upper roller 241*a* is moved away from the lower roller 241*b*, and a front end of the sheet S is moved inward between the upper roller 241*a* and the lower roller 241*b*. Thereafter, the sheet S is shifted diagonally downward along the placement surface of the processing tray 205 by, for example, an unshown paddle (otherwise, the sheet S is shifted diagonally downward by its self weight).

For discharge of the sheet S (including plural sheets S bound by staple) placed on the processing tray 205, the upper roller 241*a* is moved to approach the lower roller 241*b*, making the sheet S pinched between the upper roller 241*a* and the lower roller 241*b*, where the upper roller 241*a* and the lower roller 241*b* are rotated. As a result of this, the sheet S placed on the processing tray 205 is discharged out through the discharge opening 202. In addition, when neither the stapling process nor the classifying process is performed, the discharge part 204 discharges the sheet S out through the discharge opening 202 without placing the sheet S on the processing tray 205.

A sheet S or a sheet bundle discharged through the discharge opening 202 is stacked on the placement surface 206*a* of the discharge tray 206. The discharge tray 206 is protruded outside from within a housing of the postprocessing device 200 so as to be inclined diagonally upward from the sheet-discharge-direction upstream side (discharge opening 202 side) toward the sheet-discharge-direction downstream side. Also, in order that the sheet S or sheet bundle discharged through the discharge opening 202 is received by the discharge tray 206, one end portion of the discharge tray 206 on the downstream side of the sheet discharge direction is placed below the discharge opening 202.

The discharge tray 206 is liftable and lowerable (up/down movable). Up/down movement of the discharge tray 206 is fulfilled by an up/down moving part 208. The up/down moving part 208, although not shown, includes a pair of pulleys placed with a spacing provided therebetween in the up/down direction, an up/down belt to which the discharge tray 206 is attached and which is stretched over the pair of pulleys, an up/down guide for guiding up/down movement of the discharge tray 206, and the like. As the pulleys are rotated, the up/down belt turns around, by which the discharge tray 206 attached to the up/down belt is moved up and down. In addition, the up/down moving part 208 includes an up/down motor M3 (see FIG. 5) for rotating the pulleys.

Figure 3:
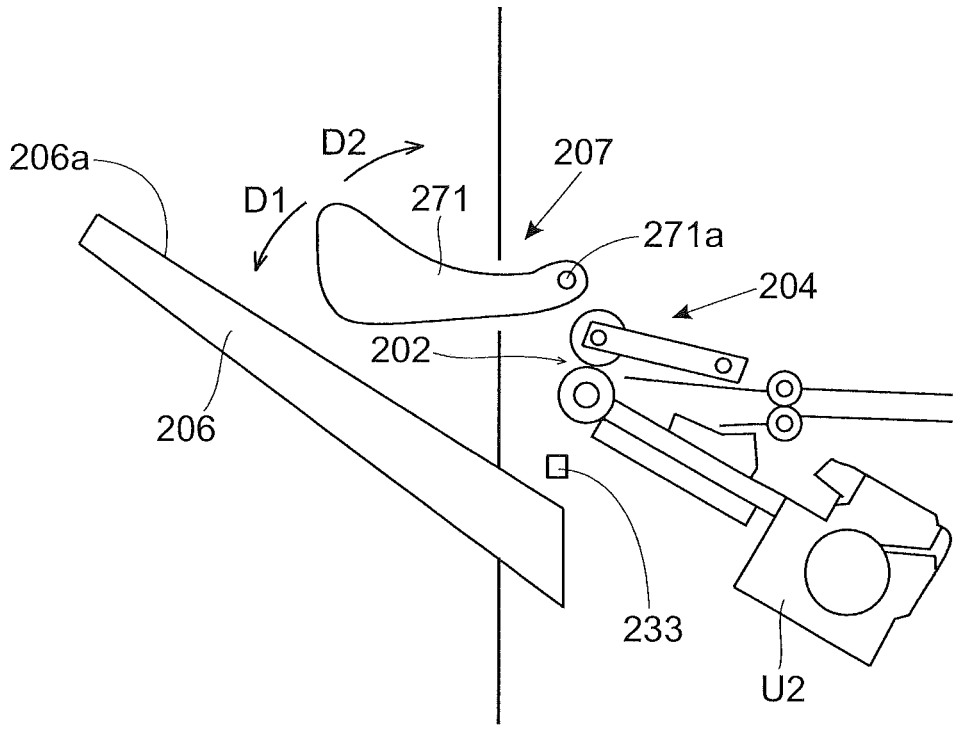
FIG. 3 is a view showing a configuration of a guide part of the postprocessing device according to one embodiment of the disclosure.

In this case, as shown in FIG. 3, a guide part 207 for guiding the sheet S to be discharged to the discharge tray 206 is provided in the postprocessing device 200. The guide part 207 includes a pair of guide plates 271 identical in shape to each other. The pair of guide plates 271, each having one guide surface, are placed such that their guide surfaces face each other in a widthwise direction (direction vertical to the drawing sheet of FIG. 3) perpendicular to the sheet discharge direction. In FIG. 3, only one guide plate 271 out of the pair of guide plates 271 is depicted.

Each of the pair of guide plates 271 has a pivotal shaft 271*a* so as to be pivotable on the pivotal shaft 271*a*. The pivotal shafts 271*a* of the pair of guide plates 271 are placed above the discharge opening 202. As the pair of guide plates 271 are pivoted in a first direction D1, the pair of guide plates 271 approach the placement surface 206*a* of the discharge tray 206. As the pair of guide plates 271 are pivoted in a second direction D2 reverse to the first direction D1, the pair of guide plates 271 go away from the placement surface 206*a* of the discharge tray 206. That is, the pair of guide plates 271 are movable in such directions as to both approach the placement surface 206*a* of the discharge tray 206 and go away from the placement surface 206*a* of the discharge tray 206. Also, the pair of guide plates 271 are movable each in the widthwise direction (direction vertical to the drawing sheet of FIG. 3) perpendicular to the sheet discharge direction.

For example, when a sheet bundle subjected to no stapling process is discharged to the discharge tray 206, guiding by the pair of guide plates 271 is executed. By this guiding, plural sheets S (unbound sheets S) contained in the sheet bundle to be discharged to the discharge tray 206 can be prevented from coming asunder. In other words, the pair of guide plates 271 perform widthwise positioning of the plural sheets S contained in the sheet bundle to be discharged to the discharge tray 206.

Figure 4:
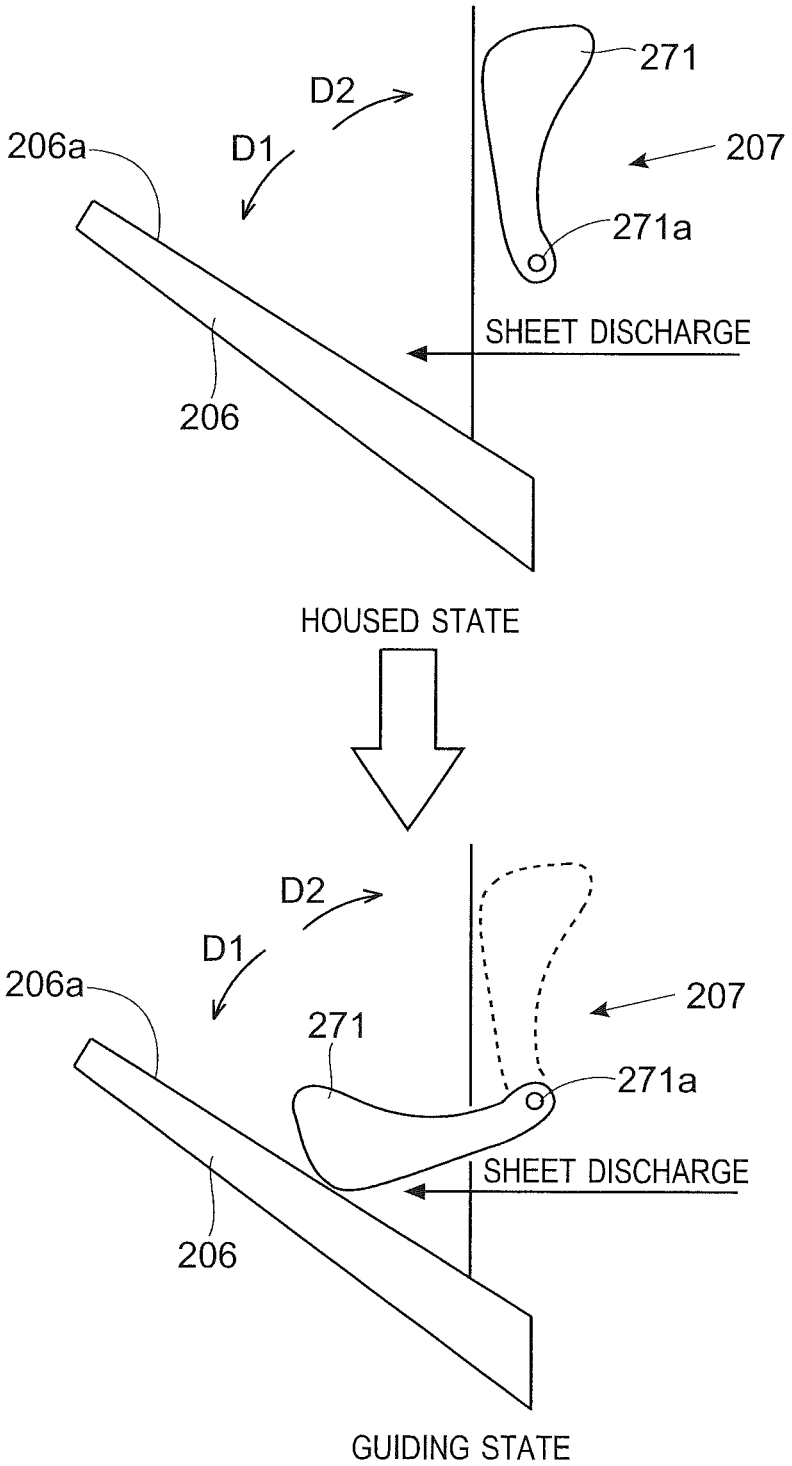
FIG. 4 is a view showing operations of the guide part of the postprocessing device according to one embodiment of the disclosure.

When the guiding by the pair of guide plates 271 is suppressed, the pair of guide plates 271 are housed in the housing of the postprocessing device 200 as shown in an upper view of FIG. 4. On the other hand, when the guiding by the pair of guide plates 271 is executed, the pair of guide plates 271 are pivoted in the first direction D1. As a result, the pair of guide plates 271 come to be placed on the placement surface 206*a* of the discharge tray 206 as shown in a lower view of FIG. 4. That is, the guiding by the pair of guide plates 271 is enabled. In addition, for execution of the guiding for a sheet bundle to be discharged to the discharge tray 206, the pair of guide plates 271 are moved in the widthwise direction in accordance with a widthwise size of the plural sheets S (unbound sheets S) contained in the sheet bundle.

As the guiding by the pair of guide plates 271 becomes no longer necessary, the pair of guide plates 271 are pivoted in the second direction D2. As a result, the pair of guide plates 271 are housed in the housing of the postprocessing device 200. That is, the resulting state is as shown in the upper view of FIG. 4.

Figure 5:
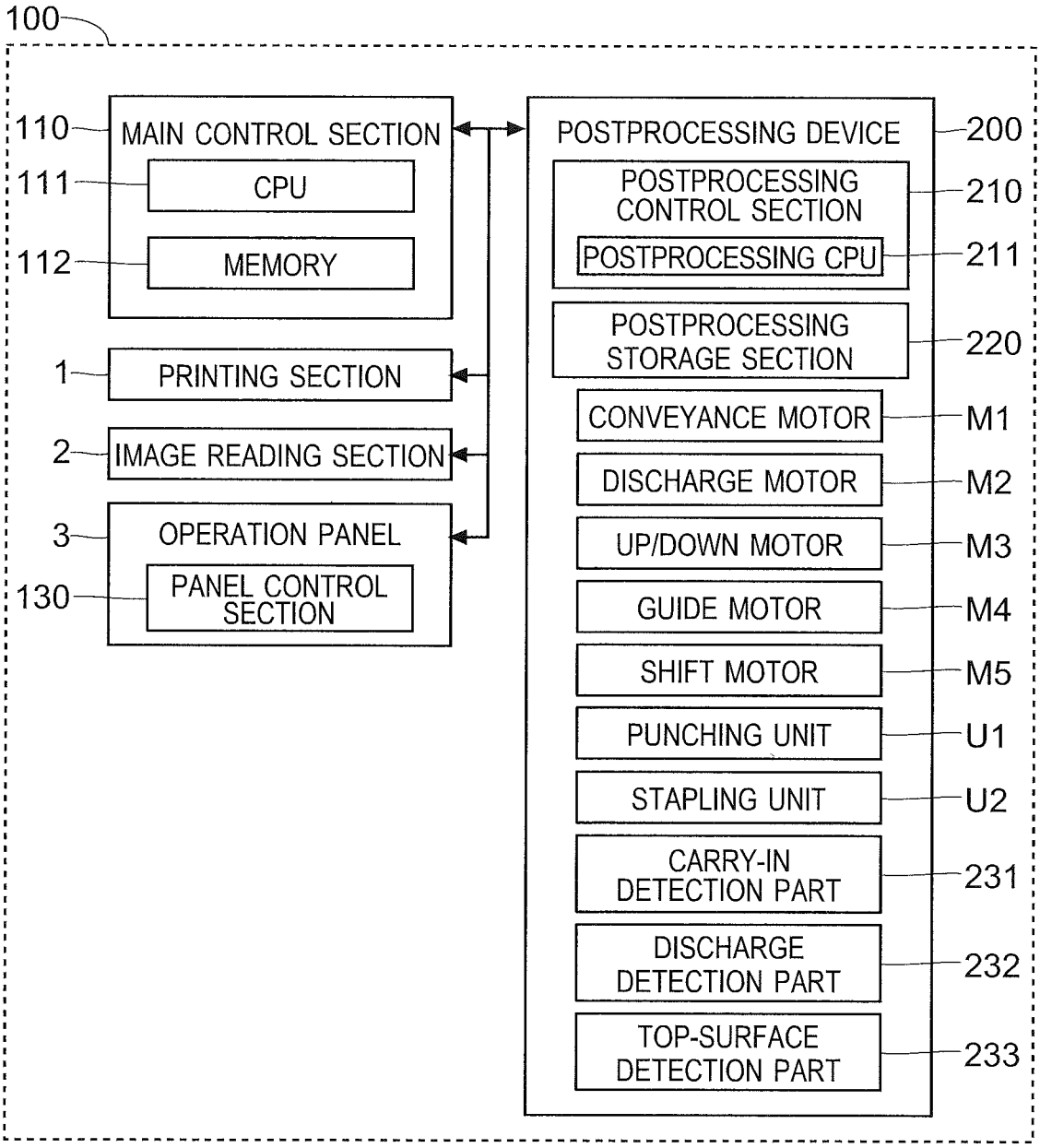
FIG. 5 is a view showing a hardware configuration of the multifunction peripheral including the postprocessing device according to one embodiment of the disclosure.

In addition, the guide part 207 includes a guide motor M4 (see FIG. 5) and a shift motor M5 (see FIG. 5). Operation of the guide motor M4 causes the pair of guide plates 271 to be pivoted in the first direction D1 and the second direction D2. Operation of the shift motor M5 causes the pair of guide plates 271 to be moved in the widthwise direction.

<Hardware Configuration of Multifunction Peripheral>

As shown in FIG. 5, the multifunction peripheral 100 includes a main control section 110. The main control section 110 includes a CPU 111 and memory 112 (ROM and RAM). Control-dedicated programs and control-dedicated data for allowing the CPU 111 to operate are stored in the memory 112. Based on the control-dedicated programs and control-dedicated data, the main control section 110 (CPU 111) controls the whole multifunction peripheral 100 as well as printing operation of the printing section 1 and reading operation of the image reading section 2, individually.

The multifunction peripheral 100 (operation panel 3) also includes a panel control section 130. The panel control section 130 is connected to the main control section 110. The panel control section 130 controls display operation of the operation panel 3 and moreover detects operations performed on the operation panel 3.

The postprocessing device 200 includes a postprocessing control section 210 and a postprocessing storage section 220. The postprocessing control section 210 corresponds to 'control section.' The postprocessing storage section 220 corresponds to 'storage section.' In addition, the control over the postprocessing device 200 may be implemented by the main control section 110.

The postprocessing control section 210 includes a postprocessing CPU 211. The postprocessing storage section 220 includes nonvolatile memory (ROM) and volatile memory (RAM) to store control-dedicated programs and control-dedicated data. Receiving instructions from the main control section 110, the postprocessing control section 210 (postprocessing CPU 211) controls postprocessing operation of the postprocessing device 200 based on the control-dedicated programs and the control-dedicated data.

More specifically, the postprocessing control section 210 controls individual operations of the punching unit U1 and the stapling unit U2. Also, the postprocessing control section 210 controls the motors M1 to M5.

The postprocessing control section 210 controls the conveyance motor M1 so as to make the conveyance roller pairs 203 properly rotated (controls conveyance of the sheet S). The postprocessing control section 210 controls the discharge motor M2 so as to make the discharge roller pair 241 properly rotated (controls discharge of the sheet S). The postprocessing control section 210 controls the up/down motor M3 so as to make the up/down belt properly turned around. That is, the postprocessing control section 210 makes the discharge tray 206 properly moved up and down (controls up/down movement of the discharge tray 206).

The postprocessing control section 210 also controls the guide motor M4 so as to make the pair of guide plates 271 properly pivoted. The postprocessing control section 210 controls the shift motor M5 so as to make the pair of guide plates 271 properly moved in the widthwise direction. That is, the postprocessing control section 210 drives the pair of guide plates 271 by using the guide motor M4 and the shift motor M5.

Control of postprocessing operations by the postprocessing control section 210 involves use of a carry-in detection part 231, a discharge detection part 232, and a top-surface detection part 233. The carry-in detection part 231, the discharge detection part 232, and the top-surface detection part 233 are connected to the postprocessing control section 210.

The carry-in detection part 231, which is placed at the carry-in opening 201, changes its output value depending on presence or absence of the sheet S at the carry-in opening 201. Based on an output value of the carry-in detection part 231, the postprocessing control section 210 detects a front-end arrival and a rear-end passage of the sheet S at the carry-in opening 201 (detects whether or not the sheet S has been carried in). Based on an output value of the carry-in detection part 231, the postprocessing control section 210 counts a number of sheets S that have been carried in the postprocessing device 200.

The discharge detection part 232, which is placed at the discharge opening 202, changes its output value depending on presence or absence of a sheet S or a sheet bundle at the discharge opening 202. Based on an output value of the discharge detection part 232, the postprocessing control section 210 detects a front-end arrival and a rear-end passage of the sheet S or the sheet bundle at the discharge opening 202 (detects whether or not the sheet S or the sheet bundle has been discharged to the discharge tray 206). When detecting a rear-end passage of the sheet S or the sheet bundle based on an output value of the discharge detection part 232, the postprocessing control section 210 decides that the sheet S or the sheet bundle has been discharged to the discharge tray 206.

The top-surface detection part 233 is a detection part which targets, as its detection position, a position lower than the discharge opening 202 (discharge roller pair 241), the detection part being for detecting whether or not the placement surface 206*a* of the discharge tray 206 moved up by the up/down moving part 208 or a top surface of the uppermost sheet S on the discharge tray 206 has arrived at the detection position. In addition, the detection position of the top-surface detection part 233 (see FIG. 2) is set to such a position that even when the placement surface 206*a* of the discharge tray 206 (or the top surface of the uppermost sheet S on the discharge tray 206) is present at the detection position of the top-surface detection part 233, the sheet S discharged from the discharge opening 202 does not interfere with the discharge tray 206 (or the uppermost sheet S on the discharge tray 206).

Although not shown, the top-surface detection part 233 includes, for example, an actuator placed at the detection position of the top-surface detection part 233, an optical sensor (sensor having a light-emitting part and a light-receiving part) whose detection object is the actuator, and the like. When the placement surface 206*a* of the discharge tray 206 moved up by the up/down moving part 208 or the top surface of the uppermost sheet S on the discharge tray 206 has arrived at the detection position, the actuator is pressed upward so as to shield (open) an optical path of the optical sensor. In this state, when the discharge tray 206 is moved down, the actuator is released from pressure so as to be moved down (returns to the original position). Thus, the optical path of the optical sensor is opened (shielded).

As a result of this, the output value of the top-surface detection part 233 (optical sensor) changes depending on whether or not the top surface of the uppermost sheet S on the placement surface 206*a* of the discharge tray 206 or on the discharge tray 206 is present at the detection position. In addition, the top-surface detection part 233 outputs a top-surface detection signal (the output level of the top-surface detection part 233 changes to a specified level) when the top surface of the uppermost sheet S on the placement surface 206*a* of the discharge tray 206 or on the discharge tray 206 has arrived at the detection position. Then, based on the output value of the top-surface detection part 233, the postprocessing control section 210 detects whether or not the top surface of the uppermost sheet S on the placement surface 206*a* of the discharge tray 206, which is moved up by the up/down moving part 208, or on the discharge tray 206 has arrived at the detection position of the top-surface detection part 233.

For execution of a print job, for example, the postprocessing control section 210 moves down the discharge tray 206 by a specified extent (distance) from a current position. Thereafter, the postprocessing control section 210 moves up the discharge tray 206 until the top-surface detection part 233 outputs the top-surface detection signal.

Since the start of the print job, the postprocessing control section 210 goes on counting discharge number of sheets S that have been discharged to the discharge tray 206. When a sheet bundle is discharged to the discharge tray 206, the number of sheets S contained in the sheet bundle is counted as the discharge number.

Then, when the discharge number has exceeded a specified number of sheets, the postprocessing control section 210 moves down the discharge tray 206 by the specified extent from the current position. As the discharge tray 206 is moved down, the sheet S or the sheet bundle is shifted diagonally downward on the discharge tray 206 so that a rear-end portion of the uppermost sheet S on the discharge tray 206 is set at a position vertically facing the top-surface detection part 233 (position where the rear-end portion of the uppermost sheet S on the discharge tray 206 can be brought into contact with the top-surface detection part 233). Thereafter, the postprocessing control section 210 moves up the discharge tray 206 until the top-surface detection part 233 outputs a top-surface detection signal. As a result of this, the vertical position of the uppermost sheet S on the discharge tray 206 is maintained at a target position (such a position as not to interfere with discharge of the next sheet S or sheet bundle).

<Stacking Failure Solving Process>

In execution of a print job involving stapling process, the postprocessing control section 210 performs a stacking failure solving process of solving a stacking failure of a stapling-processed sheet bundle (sheet bundle bound by staple) on the discharge tray 206. Hereinafter, a stapling-processed sheet bundle will be referred to as bound sheet bundle. Even when the rear-end portion of a newly discharged succeeding bound sheet bundle has caught on a staple of a precedently discharged preceding bound sheet bundle on the discharge tray 206, the catching can be solved by virtue of the stacking failure solving process performed by the postprocessing control section 210.

In the stacking failure solving process performed by the postprocessing control section 210, the pair of guide plates 271 are used. Accordingly, there is no need for independently providing a member for solving catching between the staple of a preceding bound sheet bundle and the rear-end portion of a succeeding bound sheet bundle. As a result, catching between the staple of the preceding bound sheet bundle and the rear-end portion of the succeeding bound sheet bundle can be solved without causing any cost increases.

Hereinbelow, the stacking failure solving process to be performed by the postprocessing control section 210 will be described in detail. Hereinafter, reference sign 'B' will be attached to a bound sheet bundle, and reference sign 'SN' will be attached to a staple.

Figure 6:
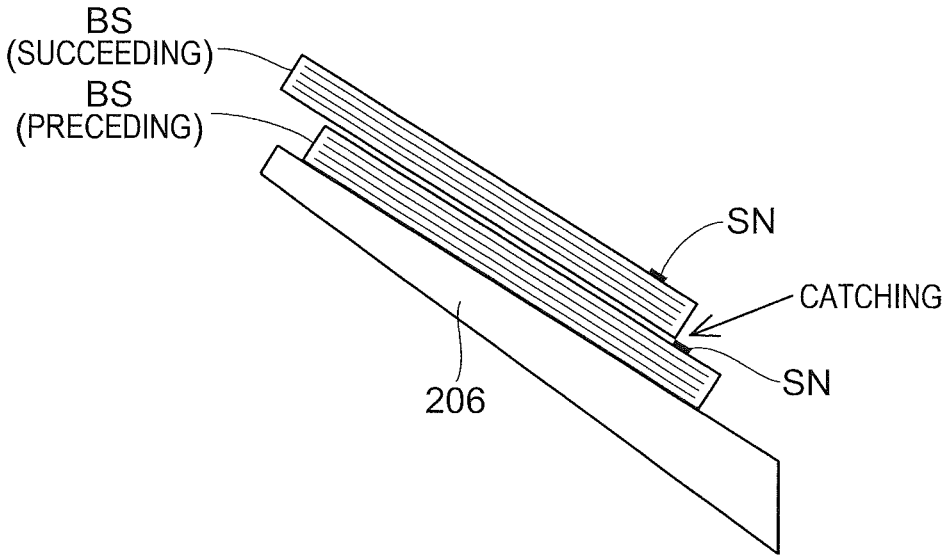
FIG. 6 is a view for explaining a stacking failure that could occur on a discharge tray of the postprocessing device according to one embodiment of the disclosure.

As shown in FIG. 6, on occurrence of a disadvantage (stacking failure) in which the rear-end portion of a succeeding bound sheet bundle BS has caught on the staple of a preceding bound sheet bundle BS, the placement position of the succeeding bound sheet bundle BS is shifted toward the downstream side in the sheet discharge direction. Upon successive occurrences of stacking failures, the resultant final state is such that a front-end portion (sheet-discharge-direction downstream-side portion) of a newly discharged bound sheet bundle BS has come out of the discharge tray 206. As a consequence, the newly discharged bound sheet bundle BS drops off from the discharge tray 206.

Also, when the rear-end portion of the succeeding bound sheet bundle BS has caught on the staple SN of the preceding bound sheet bundle BS, the succeeding bound sheet bundle BS is no longer shifted diagonally downward (rightward downward), so that the top-surface rear-end portion of the uppermost bound sheet bundle BS can no longer be brought into contact with the top-surface detection part 233 (the top-surface rear-end portion of the bound sheet bundle BS positioned below the uppermost bound sheet bundle BS is brought into contact with the top-surface detection part 233). As a consequence, there may occur a discharge failure due to blockage of the discharge opening 202 with the uppermost bound sheet bundle BS.

In order to prevent occurrence of such disadvantages, a stacking failure solving process by the postprocessing control section 210 is executed. When the stacking failure solving process is executed by the postprocessing control section 210, the bound sheet bundle BS on the discharge tray 206 is vibrated. As a result, even when the rear-end portion of the succeeding bound sheet bundle BS has caught on the staple SN of the preceding bound sheet bundle BS, the catching is solved. That is, the succeeding bound sheet bundle BS that has caught on the staple SN of the preceding bound sheet bundle BS is shifted diagonally downward (rightward downward).

Figure 7:
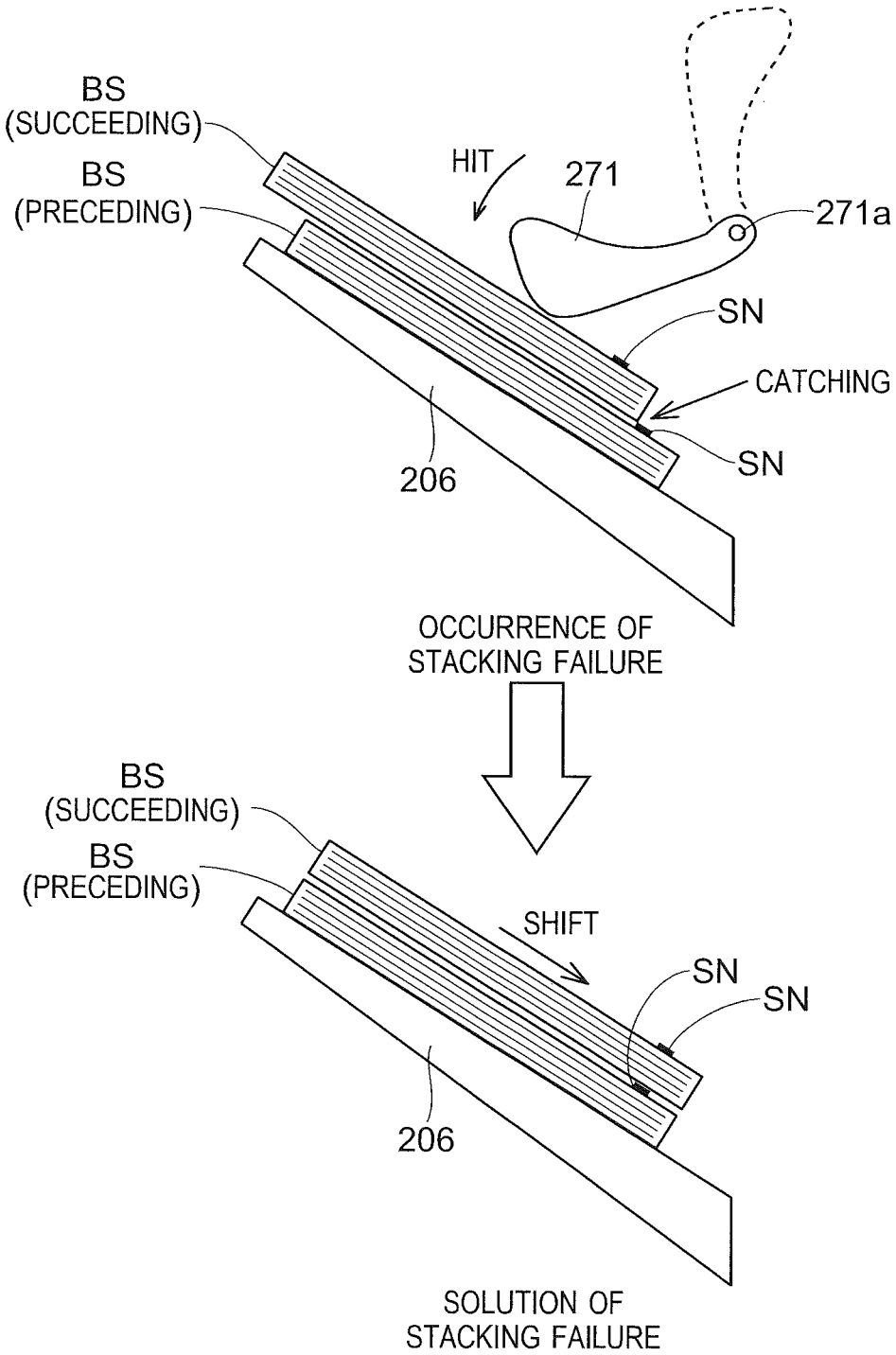
FIG. 7 is a view for explaining a solution to a stacking failure that has occurred on the discharge tray of the postprocessing device according to one embodiment of the disclosure.

As shown in an upper view of FIG. 7, the postprocessing control section 210 executes, as the stacking failure solving process, a process of driving the pair of guide plates 271 so that the pair of guide plates 271 are hit against the top surface of the bound sheet bundle BS discharged to the discharge tray 206. This process is executed each time a bound sheet bundle BS is discharged to the discharge tray 206. Like this, making the pair of guide plates 271 hit against the top surface of the bound sheet bundle BS discharged to the discharge tray 206 causes the bound sheet bundle BS on the discharge tray 206 vibrated. Thus, even though a stacking failure has occurred, the stacking failure is solved as shown in a lower view of FIG. 7.

Immediately before the bound sheet bundle BS is discharged to the discharge tray 206, the postprocessing control section 210 makes the pair of guide plates 271 pivoted in the second direction D2 and thereby housed into the housing of the postprocessing device 200 (in the upper view of FIG. 7, the pair of guide plates 271 housed in the housing of the postprocessing device 200 are shown by broken line). When the pair of guide plates 271 have already been housed in the housing of the postprocessing device 200, the postprocessing control section 210 maintains the state as it is.

In this case, since the postprocessing control section 210 makes the pair of guide plates 271 hit against the top surface of the bound sheet bundle BS discharged to the discharge tray 206, the widthwise distance between the pair of guide plates 271 is made smaller than the widthwise size of the bound sheet bundle BS discharged to the discharge tray 206 (the pair of guide plates 271 are moved in the widthwise direction). In other words, the postprocessing control section 210 performs adjustment of hitting positions of the pair of guide plates 271 against the top surface of the bound sheet bundle BS discharged to the discharge tray 206. For example, the postprocessing control section 210 adjusts widthwise positions of the pair of guide plates 271, respectively, in such fashion that each of the hitting positions is set to a position that is about one centimeter inward from each widthwise side edge (each side edge along the sheet discharge direction) of the top surface of the bound sheet bundle BS discharged to the discharge tray 206.

Then, when the bound sheet bundle BS is discharged to the discharge tray 206, the postprocessing control section 210 makes the pair of guide plates 271 pivoted in the first direction D1. As a result, the pair of guide plates 271 hit against the top surface of the bound sheet bundle BS discharged to the discharge tray 206 (in the upper view of FIG. 7, the pair of guide plates 271 in this state are shown by solid line).

In addition, each time a bound sheet bundle BS is discharged to the discharge tray 206, the postprocessing control section 210 repeats, plural times (e.g., a few times to ten odd times), the process of making the pair of guide plates 271 hit against the bound sheet bundle BS on the discharge tray 206. Further, the larger the number of bound sheets of a bound sheet bundle BS discharged to the discharge tray 206 (i.e., number of sheets S contained in the bound sheet bundle BS) is, the larger the number of hitting times of the pair of guide plates 271 against the bound sheet bundle BS on the discharge tray 206 is set by the postprocessing control section 210. As a result, the heavier the bound sheet bundle BS discharged to the discharge tray 206 is, the larger the number of hitting times becomes. Its details will be described later.

Figure 8:
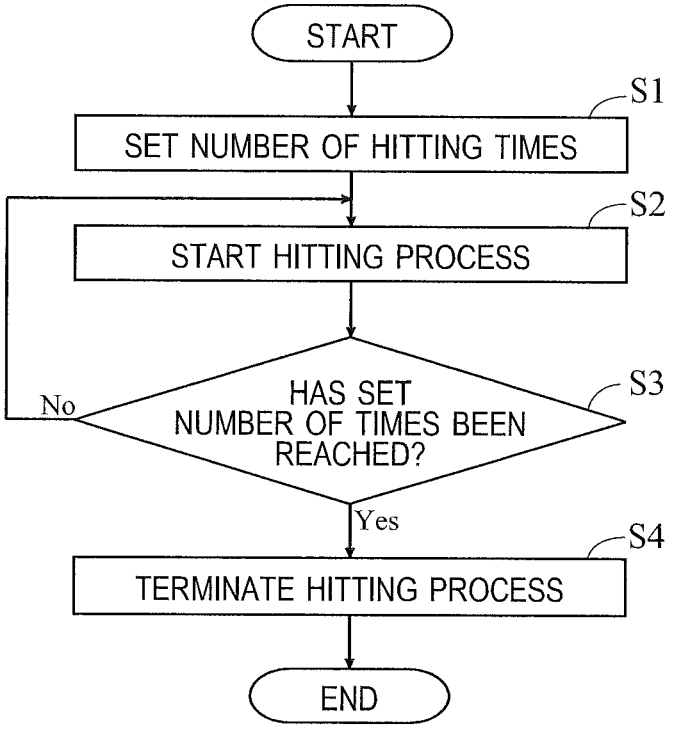
FIG. 8 is a flowchart showing a flow of a stacking failure solving process to be executed by the postprocessing device according to one embodiment of the disclosure.

Hereinbelow, a flow of the stacking failure solving process to be executed by the postprocessing control section 210 will be described with reference to the flowchart shown in FIG. 8. It is assumed that a print job involving stapling process is executed at a start time of the flowchart shown in FIG. 8. When the postprocessing control section 210 detects that the bound sheet bundle BS has been discharged to the discharge tray 206, the flowchart shown in FIG. 8 gets started.

At step S1, the postprocessing control section 210 sets a number of hitting times. The setting of the number of hitting times will be detailed later. Hereinafter, a number of hitting times set by the postprocessing control section 210 will be referred to as set number of times.

At step S2, the postprocessing control section 210 starts a hitting process of hitting the pair of guide plates 271 against the bound sheet bundle BS discharged to the discharge tray 206 (one process in the stacking failure solving process). In this case, the pair of guide plates 271 repeat a sequence of operations, i.e., first pivoting in the first direction D1 and then pivoting in the second direction D2.

For example, the postprocessing storage section 220 stores a count value for the number of hitting times. At the start time of the hitting process, the count value for the number of hitting times is 0. After the start of the hitting process, the postprocessing control section 210 makes the pair of guide plates 271 first pivoted in the first direction D1 and then pivoted in the second direction D2, followed by returning the pair of guide plates 271 to within the housing of the postprocessing device 200. Over these steps, the postprocessing control section 210 increments the count value for the number of hitting times by one.

At step S3, the postprocessing control section 210 decides whether or not the number of hitting times stored in the postprocessing storage section 220 has reached the set number of times. As a result, when deciding that the number of hitting times has reached the set number of times, the postprocessing control section 210 moves on to step S4. On the other hand, when deciding that the number of hitting times has not reached the set number of times, the postprocessing control section 210 repeats the process of step S3.

Moving to step S4, the postprocessing control section 210 ends the hitting process. That is, the postprocessing control section 210 holds the pair of guide plates 271 housed in the housing of the postprocessing device 200 (at this time point, the pair of guide plates 271 are not pivoted in the first direction D1). Also at this time point, the postprocessing control section 210 resets the count value for the number of hitting times stored in the postprocessing storage section 220.

With no bound sheet bundle BS discharged to the discharge tray 206, even when a new bound sheet bundle BS is discharged to the discharge tray 206, it never occurs, as otherwise would be a disadvantage, that the rear-end portion of a new bound sheet bundle BS catches on the staple SN of another bound sheet bundle BS. Accordingly, with a bound sheet bundle BS already discharged to the discharge tray 206, only when a new bound sheet bundle BS is discharged to the discharge tray 206, the postprocessing control section 210 executes the hitting process (process of making the pair of guide plates 271 hit against the new bound sheet bundle BS on the discharge tray 206). As a result of this, the hitting process by the postprocessing control section 210 is no longer executed unnecessarily.

Figure 9:
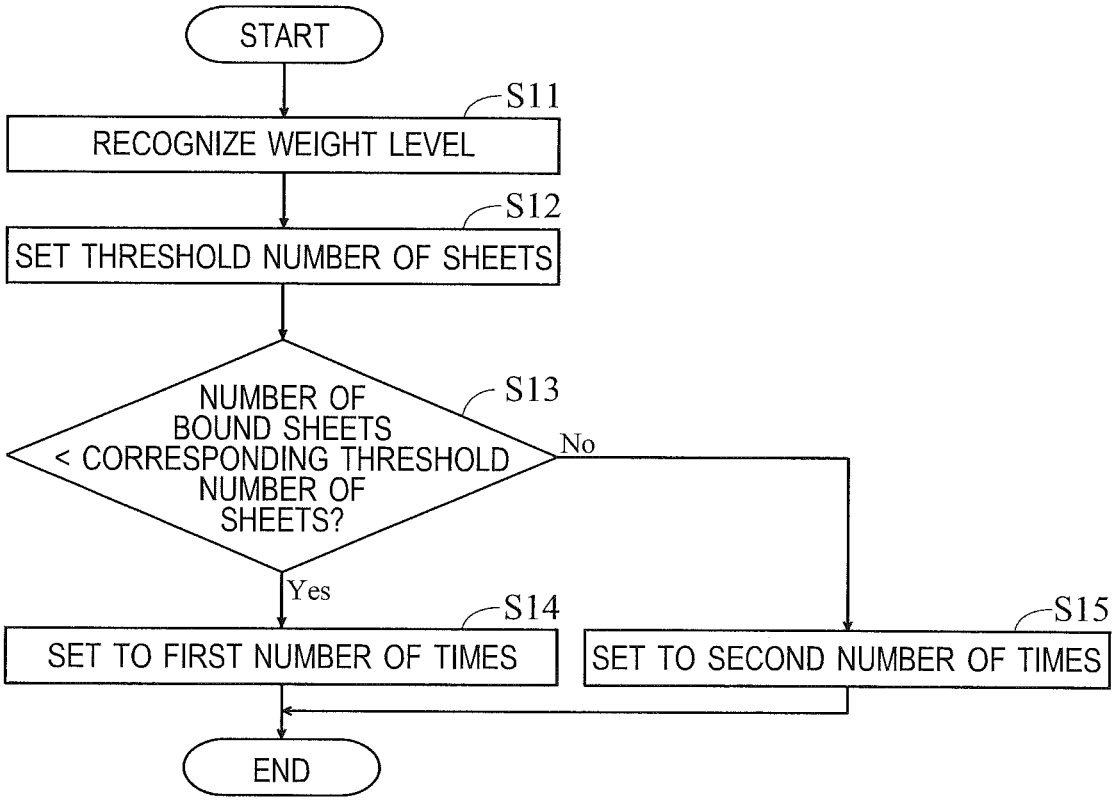
FIG. 9 is a flowchart showing a flow of a number-of-times setting process to be executed by the postprocessing device according to one embodiment of the disclosure.

Hereinbelow, a flow of a number-of-times setting process (process of setting the number of hitting times) to be executed as one process of the stacking failure solving process by the postprocessing control section 210 will be described with reference to the flowchart shown in FIG. 9.

At step S11, the postprocessing control section 210 recognizes a weight level of a sheet S to be used in a print job. Notification of the weight level of the sheet S to be used in the print job is given from the main control section 110 to the postprocessing control section 210.

For example, the operation panel 3, in execution of the print job, accepts selection of a sheet type to be used in the print job from a user. Examples of selectable sheet types include thin paper and thick paper (e.g., postcard) as well as plain paper.

With a sheet type selected, the main control section 110 discriminates a weight level corresponding to the selected sheet type. For example, level information indicative of correspondence between sheet types and weight levels has previously been stored in the memory 112 of the main control section 110. The larger the basis weight of the sheet S is, the higher the weight level of the sheet S corresponding to its sheet type becomes. In addition, it is also allowable that the user arbitrarily sets weight levels to be correspondingly associated with sheet types.

Based on the weight level information, the main control section 110 recognizes a weight level corresponding to the sheet type selected by the user, and notifies the postprocessing control section 210 of the recognized weight level. The postprocessing control section 210 recognizes the weight level notified from the main control section 110 as a weight level of the sheet S to be used in the print job (weight level of the bound sheet bundle BS discharged to the discharge tray 206).

At step S12, based on the weight level notified from the main control section 110, the postprocessing control section 210 sets a threshold number of sheets to be used in the number-of-times setting process. For example, the weight level is classified into plural steps (e.g., three steps of 'heavy,' 'ordinary,' and 'light'), and plural threshold numbers of sheets corresponding to the plural steps of weight level, respectively, are previously set and stored in the postprocessing storage section 220.

The threshold number of sheets for each weight level is so set as to decrease more and more as the corresponding weight level increases. Although not particularly limited, with the weight level classified into three steps, the threshold number of sheets corresponding to the highest level (heaviest level) is '20,' the threshold number of sheets corresponding to the medium level (ordinary level) is '50,' and the threshold number of sheets corresponding to the lowest level (lightest level) is '70.'

The postprocessing control section 210 recognizes a threshold number of sheets corresponding to the weight level notified from the main control section 110 (hereinafter, the threshold number will be referred to as corresponding threshold number of sheets), and sets the corresponding threshold number of sheets to a threshold number of sheets to be used in the number-of-times setting process. That is, the heavier the sheet S to be used in the print job is, the smaller the threshold number of sheets to be used in the number-of-times setting process is set by the postprocessing control section 210.

At step S13, the postprocessing control section 210 recognizes a bound-sheet number of the bound sheet bundle BS discharged to the discharge tray 206, and decides whether or not the recognized bound-sheet number is less than the corresponding threshold number of sheets. As a result, when deciding that the number of bound sheets is less than the corresponding threshold number of sheets, the postprocessing control section 210 moves on to step S14; and when deciding that the number of bound sheets is not less than the corresponding threshold number of sheets, the postprocessing control section 210 moves on to step S15.

Moving to step S14, the postprocessing control section 210 sets the number of hitting times to a predetermined first number of times. Moving to step S15, the postprocessing control section 210 sets the number of hitting times to a predetermined second number of times larger than the first number of times (e.g., twice larger than the first number of times). As an example, the first number of times is 'five times,' and the second number of times is 'ten times.'

The postprocessing device 200 of this embodiment, as described hereinabove, includes: the stapling unit U2 for executing a stapling process of binding a bundle of plural sheets S with a staple SN; the discharge tray 206 to which a bound sheet bundle BS as a sheet bundle bound with the staple SN is to be discharged; the pair of guide plates 271 (moving member) which are movable in both a direction of approaching the discharge tray 206 (first direction D1) and a direction of going away from the discharge tray 206 (second direction D2); and the postprocessing control section 210 (control section) for, when the bound sheet bundle BS is discharged to the discharge tray 206, driving the pair of guide plates 271 to execute a process of hitting the pair of guide plates 271 against the bound sheet bundle BS discharged to the discharge tray 206.

With the configuration of this embodiment, when the bound sheet bundle BS is discharged to the discharge tray 206, the process of making the pair of guide plates 271 hit against the bound sheet bundle BS discharged to the discharge tray 206 is executed by the postprocessing control section 210. When this process is executed, the bound sheet bundle BS discharged to the discharge tray 206 is vibrated. As a result of this, even when a rear-end portion of a newly discharged succeeding bound sheet bundle BS has caught on the staple SN of a precedently discharged preceding bound sheet bundle BS, there can be solved catching between the staple SN of the preceding bound sheet bundle BS and the rear-end portion of the succeeding bound sheet bundle BS. That is, a stacking failure of the bound sheet bundle BS on the discharge tray 206 can be solved. As a result, occurrence of disadvantages such as dropping off of the bound sheet bundle BS from the discharge tray 206 can be suppressed.

Also in this embodiment, as described above, the postprocessing storage section 220 stores a predetermined threshold number of sheets. When the bound sheet bundle BS whose number of bound sheets is less than the threshold number of sheets has been discharged to the discharge tray 206, the postprocessing control section 210 sets the number of hitting times to a predetermined first number of times (i.e., the pair of guide plates 271 are hit against the bound sheet bundle BS by the first number of times). On the other hand, when the bound sheet bundle BS whose number of bound sheets is not less than the threshold number of sheets has been discharged to the discharge tray 206, the postprocessing control section 210 sets the number of hitting times to a predetermined second number of times larger than the first number of times (the pair of guide plates 271 are hit against the bound sheet bundle BS by the second number of times). That is, the larger the number of bound sheets contained in the bound sheet bundle BS discharged to the discharge tray 206 is, the larger the number of hitting times by the pair of guide plates 271 is set by the postprocessing control section 210.

In this case, the larger the number of bound sheets is, the heavier the bound sheet bundle BS becomes. Accordingly, when the staple SN of a preceding bound sheet bundle BS has caught on the rear-end portion of a succeeding bound sheet bundle BS, the larger the number of bound sheets contained in the succeeding bound sheet bundle BS is, the stronger the engaging force between the staple SN of the preceding bound sheet bundle BS and the rear-end portion of the succeeding bound sheet bundle BS becomes. Therefore, when the bound sheet bundle BS containing a larger number of bound sheets is discharged to the discharge tray 206, it is preferable to increase the number of hitting times (number of vibration-generating times). As a result of this, there can be solved stacking failures successfully regardless of the number of bound sheets contained in the bound sheet bundle BS discharged to the discharge tray 206 (even though the bound sheet bundle BS discharged to the discharge tray 206 is heavy).

Also in this embodiment, as described above, the postprocessing storage section 220 stores threshold numbers of sheets for individual weight levels of the sheet S, respectively. In this case, the threshold numbers of sheets for individual weight levels, respectively, are so set as to decrease more and more with corresponding weight level increasingly heightening. Then, the postprocessing control section 210 recognizes a threshold number of sheets corresponding to a weight level of a sheet S contained in the bound sheet bundle BS discharged to the discharge tray 206, and sets a number of hitting times based on the recognized threshold number of sheets. As a result of this, even with a smaller number of bound sheets contained in the bound sheet bundle BS discharged to the discharge tray 206, when the weight level of the sheet S contained in the bound sheet bundle BS is a high one, i.e., when the bound sheet bundle BS is a heavy one, the number of hitting times can be set to a larger one.

The embodiment disclosed herein should be construed as not being limitative but being an exemplification at all points. The scope of the disclosure is defined not by the above description of the embodiment but by the appended claims, including all changes and modifications equivalent in sense and range to the claims.

For example, in the above embodiment, it is arranged that the pair of guide plates 271 are hit against the bound sheet bundle BS discharged to the discharge tray 206. However, the disclosure not being limited to this, it is also allowable that the pair of guide plates 271 are hit against the discharge tray 206 to which the bound sheet bundle BS has been discharged. With such a configuration as well, the bound sheet bundle BS discharged to the discharge tray 206 can be vibrated.

However, with the configuration in which the pair of guide plates 271 are hit against the discharge tray 206, sounds generated at the hitting time becomes larger than with the configuration in which the pair of guide plates 271 are hit against the bound sheet bundle BS. Accordingly, when the pair of guide plates 271 are hit against the discharge tray 206, it is preferable to set the number of hitting times to smaller ones than when the pair of guide plates 271 are hit against the bound sheet bundle BS.

Also with this configuration, increased numbers of bound sheet bundles BS discharged to the discharge tray 206 would make it impossible for the pair of guide plates 271 to be hit against the discharge tray 206. This is because the discharge tray 206 is moved down more and more as the number of bound sheet bundles BS discharged to the discharge tray 206 increases more and more. Accordingly, it may be arranged that when the bound sheet bundle BS has been discharged to the discharge tray 206 while the discharge tray 206 is located at such a position that pivoting the pair of guide plates 271 in the first direction D1 would cause the pair of guide plates 271 to be hit against the discharge tray 206, the pair of guide plates 271 are hit against the discharge tray 206. Moreover, when the bound sheet bundle BS has been discharged to the discharge tray 206 while the discharge tray 206 is located at such a position that even pivoting the pair of guide plates 271 in the first direction D1 would cause the pair of guide plates 271 to remain out of contact with the discharge tray 206, the pair of guide plates 271 may be hit against the bound sheet bundle BS.

What is claimed is:

1. A postprocessing device comprising:

a stapling unit for executing a stapling process of stapling a sheet bundle with a staple;

a discharge tray to which a bound sheet bundle bound with the staple is to be discharged;

a moving member which is movable in both a direction of approaching the discharge tray and a direction of going away from the discharge tray; and a control section for, when the bound sheet bundle has been discharged to the discharge tray, driving the moving member to execute a process of making the moving member hit against the bound sheet bundle discharged to the discharge tray or against the discharge tray;

wherein the control section increases a number of hitting times by the moving member more and more with increasing number of bound sheets contained in the bound sheet bundle discharged to the discharge tray.

2. The postprocessing device according to claim 1, further comprising a storage section for storing a predetermined threshold number of sheets, wherein when the bound sheet bundle whose number of bound sheets is less than the threshold number of sheets has been discharged to the discharge tray, the control section sets the number of hitting times to a predetermined first number of times; and when the bound sheet bundle whose number of bound sheets is not less than the threshold number of sheets has been discharged to the discharge tray, the control section sets the number of hitting times to a predetermined second number of times larger than the first number of times.

3. The postprocessing device according to claim 2, wherein the storage section stores the threshold number of sheets for each one of weight levels of a sheet, the threshold numbers of sheets corresponding to the weight levels, respectively, are so set as to decrease more and more with corresponding weight level increasingly heightening, and the control section recognizes one of the threshold numbers of sheets corresponding to the weight level of the sheet contained in the bound sheet bundle discharged to the discharge tray, and sets the number of hitting times based on the recognized threshold number of sheets.

4. The postprocessing device according to claim 1, wherein the moving member is movable in a widthwise direction perpendicular to a sheet discharge direction, and when an unbound sheet unprocessed for the stapling process is discharged to the discharge tray, the control section performs alignment of the unbound sheet in the widthwise direction by using the moving member.

5. An image forming apparatus comprising the postprocessing device according to claim 1.

6. A postprocessing device comprising:

a stapling unit for executing a stapling process of stapling a sheet bundle with a staple;

a discharge tray to which a bound sheet bundle bound with the staple is to be discharged;

a moving member which is movable in both a direction of approaching the discharge tray and a direction of going away from the discharge tray; and a control section for, when the bound sheet bundle has been discharged to the discharge tray, driving the moving member to execute a process of making the moving member hit against the bound sheet bundle discharged to the discharge tray or against the discharge tray;

wherein with the bound sheet bundle already discharged to the discharge tray, when a new one of the bound sheet bundle has been discharged to the discharge tray, the control section executes the process of making the moving member hit; and with none of the bound sheet bundle discharged to the discharge tray, when a new one of the bound sheet bundle has been discharged to the discharge tray, the control section suppresses the process of making the moving member hit.

7. An image forming apparatus including the post processing device according to claim 6.

8. A postprocessing device comprising:

a stapling unit for executing a stapling process of stapling a sheet bundle with a staple;

a discharge tray to which a bound sheet bundle bound with the staple is to be discharged;

a moving member which is movable in both a direction of approaching the discharge tray and a direction of going away from the discharge tray; and a control section for, when the bound sheet bundle has been discharged to the discharge tray, driving the moving member to execute a process of making the moving member hit against the bound sheet bundle discharged to the discharge tray or against the discharge tray;

wherein:

the discharge tray is movable up and down, and in a state that the discharge tray is located at such a position that moving the moving member in a direction of approaching the discharge tray would cause the moving member to be brought into contact with the discharge tray, the control section makes the moving member hit against the discharge tray when the bound sheet bundle has been discharged to the discharge tray; and in a state that the discharge tray is located at such a position that even moving the moving member in the direction of approaching the discharge tray would cause the moving member to remain out of contact with the discharge tray, the control section makes the moving member hit against the bound sheet bundle when the bound sheet bundle has been discharged to the discharge tray.

9. An image forming apparatus including the post processing device according to claim 8.

10. A postprocessing device comprising:

a stapling unit for executing a stapling process of stapling a sheet bundle with a staple;

a discharge tray to which a bound sheet bundle bound with the staple is to be discharged;

a moving member which is movable in both a direction of approaching the discharge tray and a direction of going away from the discharge tray; and a control section for, when the bound sheet bundle has been discharged to the discharge tray, driving the moving member to execute a process of making the moving member hit against the bound sheet bundle discharged to the discharge tray or against the discharge tray;

wherein when making the moving member hit against the discharge tray, the control section sets a number of hitting times by the moving member to a smaller one than when making the moving member hit against the bound sheet bundle.

11. An image forming apparatus including the post processing device according to claim 10.

* * * * *